US005953573A

United States Patent [19]

Eum

[11] Patent Number: 5,953,573

[45] Date of Patent: Sep. 14, 1999

[54] ELECTROPHOTOGRAPHIC PRINTER

[75] Inventor: Jae-yong Eum, Suwon, Rep. of Korea

[73] Assignee: Samsung Electronics Co., Ltd., Kyungki-Do, Rep. of Korea

[21] Appl. No.: 09/084,446

[22] Filed: May 27, 1998

[30] Foreign Application Priority Data

Aug. 30, 1997 [KR] Rep. of Korea ..... 97-44404

[51] Int. Cl.[6] ..... G03G 15/16

[52] U.S. Cl. ..... 399/308; 399/313

[58] Field of Search ..... 399/313, 317, 399/318, 297, 298, 302, 308, 309; 430/124

[56] References Cited

U.S. PATENT DOCUMENTS 3,848,204 11/1974 Draugelis et al. ..... 399/314
5,070,366 12/1991 Tsuchiya ..... 399/167
5,374,982 12/1994 Boockkholdt ..... 399/318

FOREIGN PATENT DOCUMENTS 9-244422 9/1997 Japan ..... G03G 15/16

*Primary Examiner*—Arthur T. Grimley
*Assistant Examiner*—Hoang Ngo
*Attorney, Agent, or Firm*—Sughrue, Mion, Zinn, Macpeak & Seas, PLLC

[57] ABSTRACT

An electrophotographic printer including a backup roller for supporting a photosensitive belt, a pressing roller for pressing a supplied paper, a transfer roller selectively contacting or being separated from the backup roller and the pressing roller while moving forward or backward between the backup roller and the pressing roller, and a driving unit for moving the transfer roller forward and backward. The transfer roller, the backup roller and the pressing roller are easily aligned with accuracy, and the impacts occurring when the rollers contact each other and are separated from each other are made less severe.

5 Claims, 4 Drawing Sheets

ELECTROPHOTOGRAPHIC PRINTER

BACKGROUND OF THE INVENTION

1. Field of the Invention

The present invention relates to an electrophotographic printer, and more particularly, to an electrophotographic printer having a transfer unit with an improved structure.

2. Description of the Related Art

Generally, an electrophotographic printer such as a laser printer or a photocopy machine includes a photosensitive medium such as photosensitive belt on which an electrostatic latent image is formed by an image forming unit. The latent image formed on the photosensitive belt is developed in a developing unit by applying toner thereon.

Then, the developed image is printed on paper via a transfer roller by a transferring unit. The transfer roller is interposed between a backup roller and a pressing roller, and the photosensitive belt travels between the backup roller and the transfer roller, and the paper is provided between the transfer roller and the pressing roller. Thus, the image on the photosensitive belt is transferred onto the transfer roller and then printed on the paper.

Here, during the printing operation, the backup roller, the transfer roller and the pressing roller are adjacent to each other. At times other than the printing operation, the rollers are separated from each other. That is, the transfer roller and the pressing roller are separated from the backup roller, arid then the pressing roller is separated from the transfer roller.

Thus, repeated contact and separation of the three rollers may cause misalignment of the rollers. Also, when the rollers approach each other, vibration may occur due to their contact. In addition, when the vibration is transmitted to the developing unit, an image developing function may be detrimentally affected.

SUMMARY OF THE INVENTION

To solve the above problems, it is an objective of the present invention to provide an electrophotographic printer in which the structure of a transferring unit is improved such that a transfer roller, a pressing roller and a transferring roller are easily aligned, and impacts that occur when the rollers contact each other are made less severe.

Accordingly, to achieve the above objective, there is provided an electrophotographic printer comprising: a backup roller for supporting a photosensitive belt; a pressing roller for pressing a supplied paper; a transfer roller selectively contacting or being separated from the backup roller and the pressing roller while moving forward or backward between the backup roller and the pressing roller; and a driving means for moving the transfer roller forward and backward.

Preferably, the driving means comprises: a bracket to which a rotary shaft of the transfer roller is rotatably connected; a support having one end coupled with the bracket; a crank shaft rotatably connected to the other end of the support in the vertical direction; a rotary disk to which the crank shaft is eccentrically coupled; and a motor for rotating the rotary disk.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT

Figure 1:
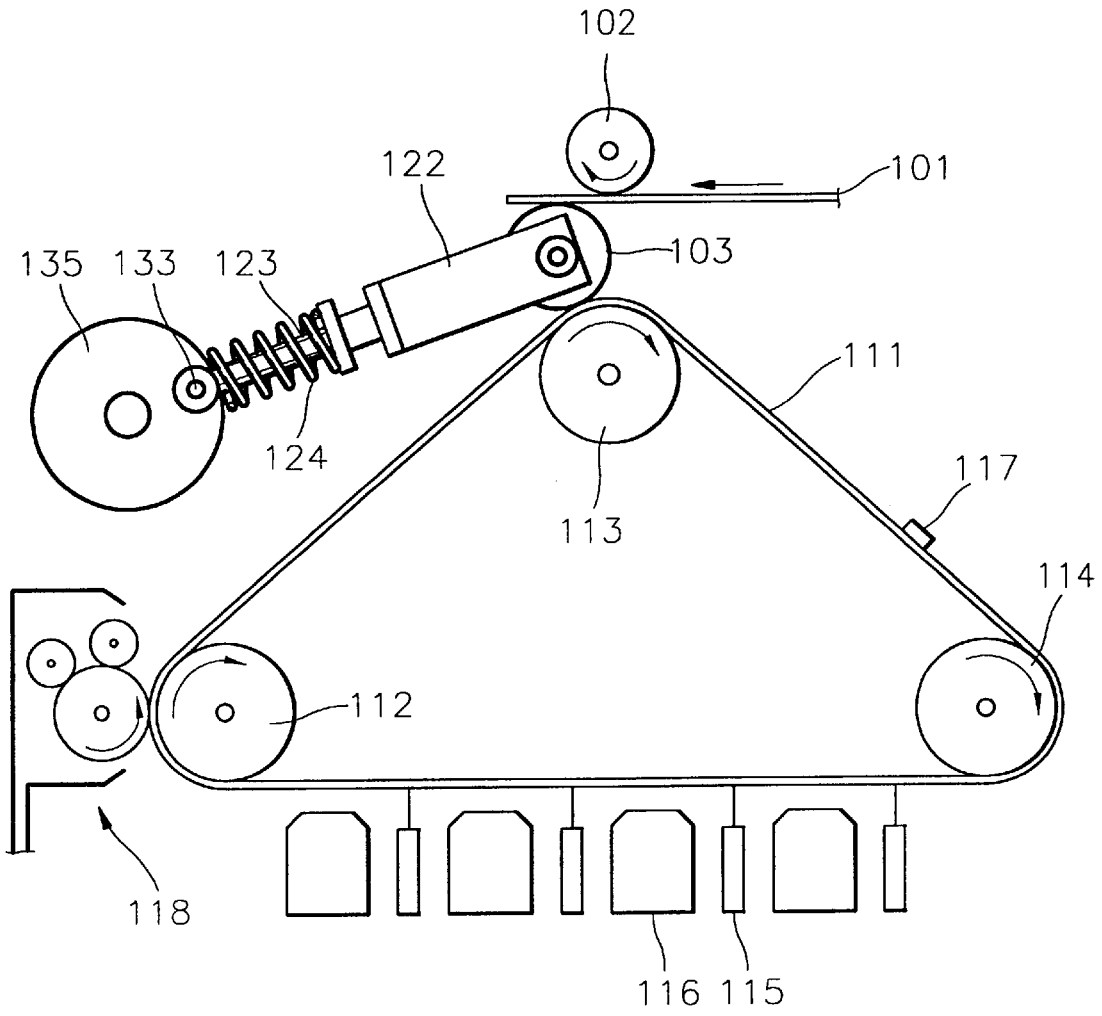
FIG. 1 is a schematic view showing the structure of an electrophotographic printer according to a preferred embodiment of the present invention.

Referring to FIG. 1 which shows a liquid electrophotographic printer according to a preferred embodiment of the present invention, a photosensitive belt 111 is supported around rollers 112, 113 and 114 to travel.

The driving roller 112 rotating by a motor (not shown) circulates the photosensitive belt 111, and the buffering roller 114 appropriately controls the tension of the photosensitive belt 111.

Also, a charging device 117 for uniformly charging the surface of the photosensitive belt 111 is placed at one side of the photosensitive belt 111. Also, an image forming unit 115 for forming a latent image by irradiating a laser onto the photosensitive belt 111 according to an image signal, and a developing unit 116 for developing the latent image by supplying a developer liquid containing toner and a liquid carrier on the surface of the photosensitive belt 111 on which the electrostatic latent image has been formed are installed along the traveling path of the photosensitive belt 111. Liquid carrier remaining on the photosensitive belt 111 is removed through evaporation by a drying unit 118, and the toner image of the photosensitive belt 111 is printed on paper by a transferring unit.

Figure 2:
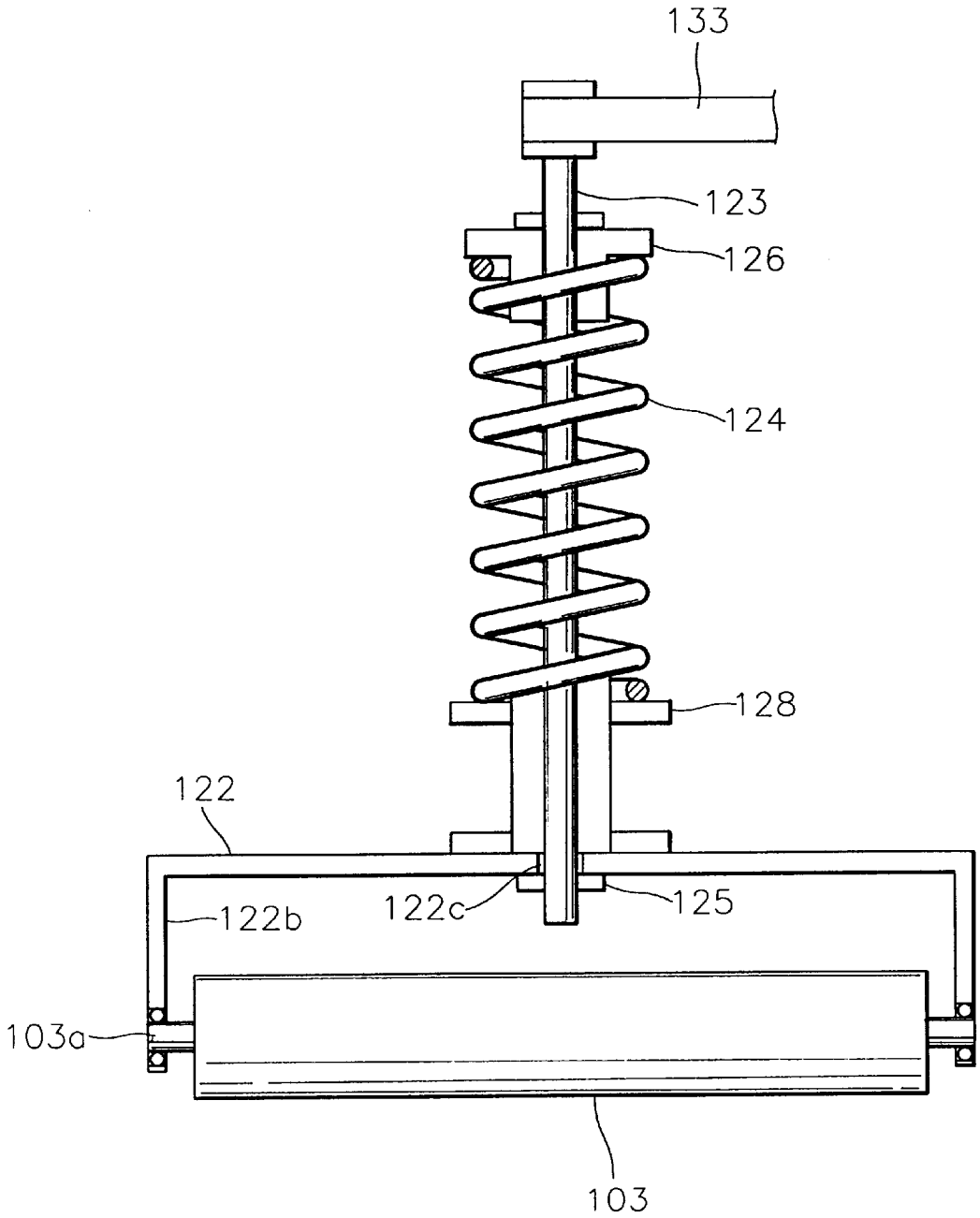
FIG. 2 is a plan view of the transfer roller and the driving means of FIG. 1.

Referring to FIGS. 1 and 2, the transferring unit includes the backup roller 113, the pressing roller 102 and the transfer roller 103 positioned between the backup roller 113 and the pressing roller 102. The photosensitive belt 111 travels between the backup roller 113 and the transfer roller 103, and paper 101 is provided between the transfer roller 103 and the pressing roller 102. That is, the backup roller 113 supports the photosensitive belt 111, and the transfer roller 103 contacts the photosensitive belt 111 to apply pressure against the backup roller 113. Also, the transfer roller 103 contacts the paper 101 to apply pressure against the pressing roller 102, and the image on the photosensitive belt 111 is simultaneously transferred onto the paper 101.

According to the present invention, the transfer roller 103 is selectively pushed against or separated from the pressing roller 102 and the backup roller 113 by a driving means. The driving means moves the transfer roller 103 forward and backward between the pressing roller 102 and the backup roller 113.

A rotary shaft 103*a* of the transfer roller 103 is rotatably supported by a bracket 122. One end of a support 123 is inserted into a through hole 122*c* formed in the bracket 122 and coupled by a fixing nut 125. Also, a crank shaft 133 coupled to the rotary disk 135 (see FIG. 3) is rotatably coupled to the other end of the support 123 in the vertical direction.

A control nut 128 and a fixing member 126 are connected to the support 123, and a spring 124 is interposed therebetween. The spring 124 elastically biases the bracket 122 forward, which absorbs impacts occurring when the transfer roller 103 contacts the backup roller 113 and the pressing roller 102. The elastic force of the spring 124 can be appropriately controlled by rotating the control nut 128 to control the length of the spring 124.

Figure 3:
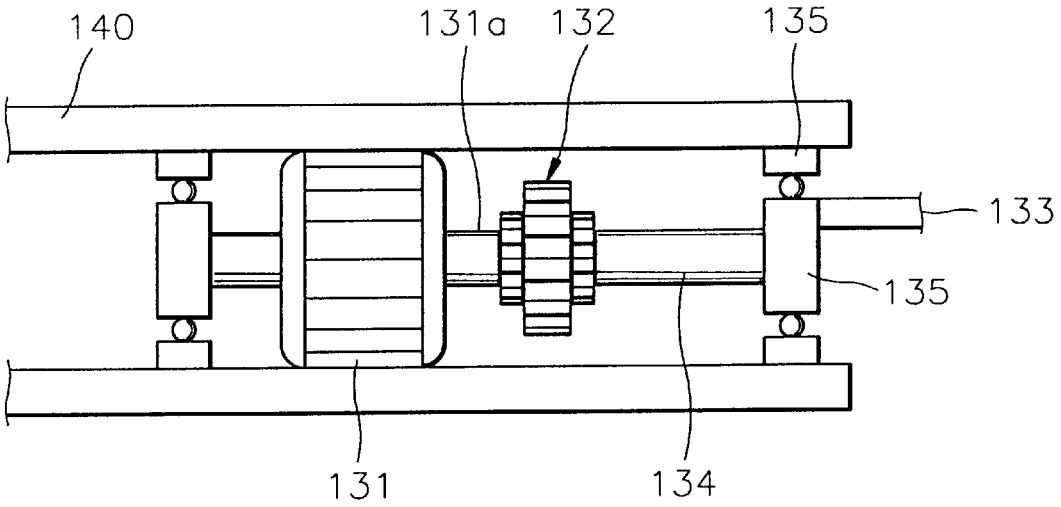
FIG. 3 is a diagram showing the motor and the rotary disk of the driving means of FIG. 1.

Referring to FIG. 3, the transfer roller 103 travels forward and backward by the rotation of a motor 131. The crank shaft 133, coupled with the support 123 which is connected to the transfer roller 103, is eccentrically coupled with the rotary disk 135. Also, the rotary disk 135 is coupled with a rotary shaft 134 of a reduction gear 132 which is connected with a rotary shaft 131*a* of the motor 131 to receive the rotating force of the motor 131. Thus, when the rotary disk 135 rotates by the rotating force of the motor 131, the crank shaft 133 has a circular motion so that the support 123 reciprocates.

Reference numeral 140 represents a housing enclosing the motor 131 and the rotary disk 135.

Referring to FIGS. 1 through 3, the operation of the transferring unit of the printer according to the present invention, having the above structure, will be described.

During the printing process, the transfer roller 103 travels forward between the backup roller 113 and the pressing roller 102. That is, as described above, the rotating force of the motor 131 (see FIG. 3) is transferred to the rotary disk 135 via the reduction gear 132. When the rotary disk 135 rotates a predetermined amount, the crank shaft 133 moves in a circle, so that the support 123 connected to the crank shaft 133 travels forward. Thus, the transfer roller 103 travels forward between the backup roller 113 and the pressing roller 102 contacting therewith. The photosensitive belt 111 is placed between the transfer roller 103 and the backup roller 113, and the paper 101 is placed between the transfer roller 103 and the pressing roller 102.

Figure 4:
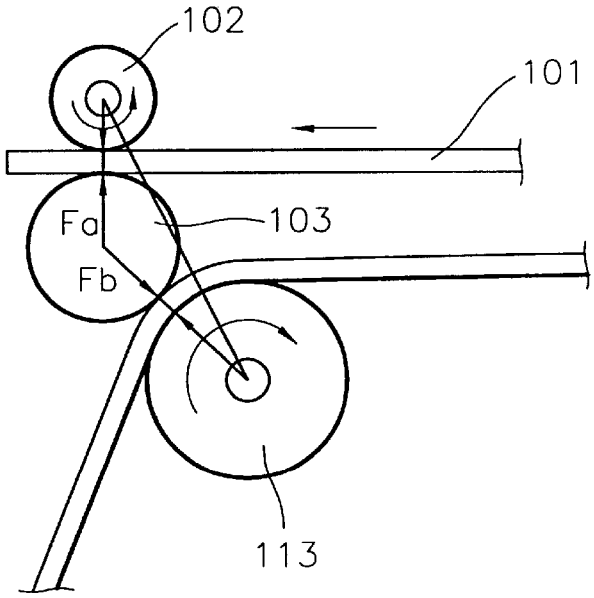
FIGS. 4 and 5 are diagrams showing the repelling forces and the contact directions between the transfer roller, the backup roller and the pressing roller.

Here, as shown in FIG. 4, preferably, the pressing force of the transfer roller 103 against the pressing roller 102 and the backup roller 113 is appropriately controlled such that the repelling force $F_a$ between the pressing roller 102 and the transfer roller 103 is the same as the repelling force $F_b$ between the transfer roller 103 and the backup roller 113. If the two repelling forces are not equal to each other, the stress is concentrated on one side so that it is difficult to align the rollers accurately and thus the degree of impact caused by the contact increases.

Figure 5:
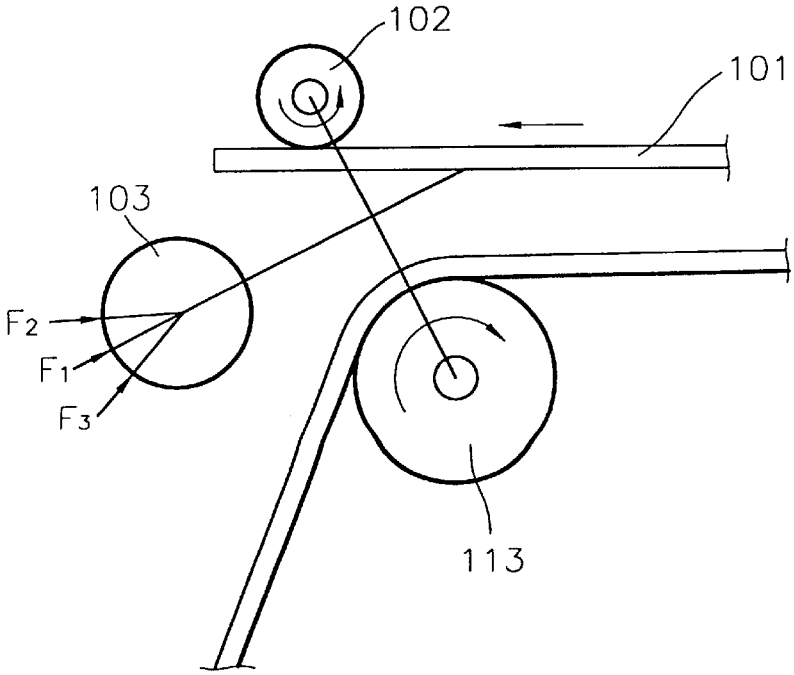

As shown in FIG. 5, if the repelling force $F_a$ between the transfer roller 103 and the pressing roller 102 is equal to the repelling force $F_b$ between the transfer roller 103 and the backup roller 113, the transfer roller 103 travels in the direction $F_1$. However, if the repelling force $F_a$ is greater than the repelling force $F_b$, the transfer roller 103 is guided to travel in the direction $F_3$, thereby increasing pressure against the pressing roller 102. Also, when the repelling force $F_b$ is greater than the repelling force $F_a$, the transfer roller 103 is guided to travel in the direction $F_2$, thereby increasing the pressure against the backup roller 113.

When printing process is completed, the support 123 moves back by the rotation of the motor 131 and the rotary disk 135, so that the transfer roller 103 is separated from the pressing roller 102 and the backup roller 113.

The impact occurring when the transfer roller 103 contacts the rollers and the impact occurring when the transfer roller 103 is separated therefrom can be absorbed by the buffering action of the spring 124.

The electrophotographic printer according to the present invention can contact the transfer roller with the other rollers and separate the transfer roller therefrom by adopting a comparatively simple structure, and the impacts occurring when the rollers contact each other and are separated from each other can be absorbed. As a result, deterioration in the development of the latent image, caused by the impacts, can be reduced.

The present invention has been illustrated with reference to the embodiment shown in the drawings. However, the present invention is not limited to the embodiment described, and further modifications and alterations will occur to those skilled in the art within the scope and spirit of the following claims.

What is claimed is:

1. An electrophotographic printer comprising:

a photosensitive belt (111); a backup roller (113) for supporting said photosensitive belt; a pressing roller (102) supported outside said photosensitive belt for pressing a supplied paper;

a transfer roller (103) disposed for movement towards and away from said backup roller and said pressing roller, said transfer roller being positioned to contact the paper pressed by said pressing roller and said photosensitive belt supported by said backup roller; and a resilient member biasing the transfer roller against both said backup roller and said pressing roller with substantially equal force between the transfer roller and the backup roller and between the transfer roller and the pressing roller.

2. The electrophotographic printer of claim 1, further comprising:

a bracket (122) and a rotary shaft (103*a*) supporting said transfer roller relative to said bracket;

a support (123) having one end coupled with said bracket;

a crank shaft (133) connected to another end of said support, said crank shaft extending at a predetermined angle with respect to a longitudinal axis of said support;

a rotary disk (135) to which said crank shaft is eccentrically coupled; and a motor (131) for rotating the rotary disk.

3. The electrophotographic printer of claim 2, wherein said bracket is movably coupled with said one end of said support, and said resilient member is a spring (124) for providing an elastic force against said bracket to absorb an impact between said transfer roller and said backup roller and between said transfer roller and said pressing roller.

4. The electrophotographic printer of claim 3, wherein said spring is positioned between a fixing member (126) fixed to said support and a control nut (128), and said control nut is threadably engaged with a member fixed to said bracket, whereby the elastic force of said spring is adjustable by rotating said control nut to lengthen or shorten said spring.

5. The electrophotographic printer of claim 2, further comprising a reduction gear (132) for reducing a rotating force of the motor and transferring the rotating force to said rotary disk.

* * * * *